US005192210A

United States Patent [19]

Thomas et al.

[11] Patent Number: 5,192,210

[45] Date of Patent: Mar. 9, 1993

[54] TRAINING APPARATUS FOR CATTLE ROPING

[76] Inventors: Darrell E. Thomas, P.O. Box 1103; Donald E. Standley, Rt. 2 Box 86B, Haynes Rd.; Leon J. Jackson, Rt. 2, Box 817B, all of Anahuac, Tex. 77514

[21] Appl. No.: 767,104

[22] Filed: Sep. 27, 1991

[51] Int. Cl.[5] ..... A63B 69/00; G09B 9/00

[52] U.S. Cl. ..... 434/247; 273/DIG. 19; 434/219

[58] Field of Search ..... 273/336, 338, 339, 407, 273/414, DIG. 19; 434/247, 219; 119/29, 153, 151; 446/26, 28; 2/311, 312

[56] References Cited

U.S. PATENT DOCUMENTS

D. 172,028 4/1954 Hull .
1,914,732 6/1933 Breault .
2,122,606 7/1938 Dobbie .
2,264,214 11/1941 Lawrence .
2,534,904 12/1950 Feero .
2,624,957 1/1953 Collins .
3,715,832 2/1973 Torres .
4,268,037 5/1981 McKinley et al. .
4,333,642 6/1982 Adams .
4,353,546 10/1982 Rhoades .
4,364,570 12/1982 Hallam .
4,498,676 2/1985 Runner ..... 273/336
4,848,067 7/1989 Martinsen ..... 446/28 X
5,080,373 1/1992 Jones ..... 273/338

*Primary Examiner*—Richard J. Apley
*Assistant Examiner*—Karen A. Jalbert
*Attorney, Agent, or Firm*—Pravel, Gambrell, Hewitt, Kimball & Krieger

[57] ABSTRACT

A training apparatus is provided for cattle roping to be used by a roper. The training apparatus includes a frame assembly and straps for securing the frame assembly to the body of the roper. A saddle horn is attached to the frame assembly at a location representing the distance relationship between the roper and the saddle horn when the roper is actually on a saddle on horseback. The apparatus allows a roper to simulate a variety of roping conditions likely to be encountered.

14 Claims, 1 Drawing Sheet

TRAINING APPARATUS FOR CATTLE ROPING

BACKGROUND OF THE INVENTION

1. Field of the Invention

The present invention relates in general to training apparatus for cattle roping and, in particular, a dally practice apparatus.

2. Description of the Prior Art

In certain rodeo events, such as team steer roping, and in actual cattle working operations, it is often required for a pair of ropers to rope an animal as a team. One roper ropes the animal around the head while the other ropes the hind legs or heels of the animal. Each roper's work must be done while on horseback. Each rider must after roping then perform a "dally," i.e., wrapping an end of the rope around the roper's saddle horn. The dally enables the rider to exert pressure and contain the animal at the other end of the rope and further allows the rider to quickly release the roped animal, if and when necessary, by releasing the free end of the rope which then is free to unwrap itself from the saddle horn.

In rodeo competition, the steer roping event is best described as fast paced action and there is no room for error. It is a race against the clock and only hundredths of a second may distinguish the winners from the losers. Thus, it is vitally important that each phase of the event be performed as rapidly and instinctively as possible. Many hours of practice are spent in the practice of roping and the formation of the dally. It is also vitally important to practice the formation of the dally to prevent the roping horseback rider's finger, thumb, or hand from being caught between the saddle horn and the rope during the formation of the dally. In the event this occurs, the extreme tension in the rope can sever a finger or severely damage a hand or wrist. Somewhat surprisingly, experience has shown that the risk of injury is greater if the horseback rider looks at the rope and saddle horn while forming the dally than if the rider is looking at the roped stock. Thus, it is extremely crucial that the rider be able to instinctively form the dally, without looking down at the saddle horn, while maintaining eye contact and attention on the action at the other end of the rope.

U.S. Pat. No. 4,353,546 relates to a dally practice apparatus wherein the "rider" sits on a saddle mounted on a saddle support while holding one end of a rope which passes though a pulley apparatus and has a second end suspending a weight therefrom to maintain tension in the rope while forming the dally and to simulate the pulling force of a roped animal at the end of the rope. The dally practice apparatus does not allow practice of the rapid roping and dally sequence, nor does it allow movement or position adjustment simulation for the roper with respect to the animal, either prior to or after the animal has been roped.

SUMMARY OF THE PRESENT INVENTION

Briefly, the present invention is an improved training apparatus for cattle roping. The training apparatus includes a box-like frame assembly to which a saddle horn is attached. The frame assembly has straps attached to it enabling the frame assembly to be secured around the roper's hips. With the apparatus secured around the roper's hips, the saddle horn mounted on the frame assembly is in the same location as if the roper were sitting on an actual saddle on horseback. With the apparatus in place, certain roping/dally operations may be practiced without the need for either a horse or a saddle.

The present invention has several desirable features over the prior art. It provides a portable, lightweight, and compact training apparatus which is easily transportable. It allows the roper to practice both the roping and the formation of the dally from a variety of positions and while moving towards a "steer" dummy.

BRIEF DESCRIPTION OF THE DRAWINGS

A better understanding of the present invention may be had by reference to the following drawings and contained numerals therein of which.

DETAILED DESCRIPTION OF THE INVENTION

Figure 1:
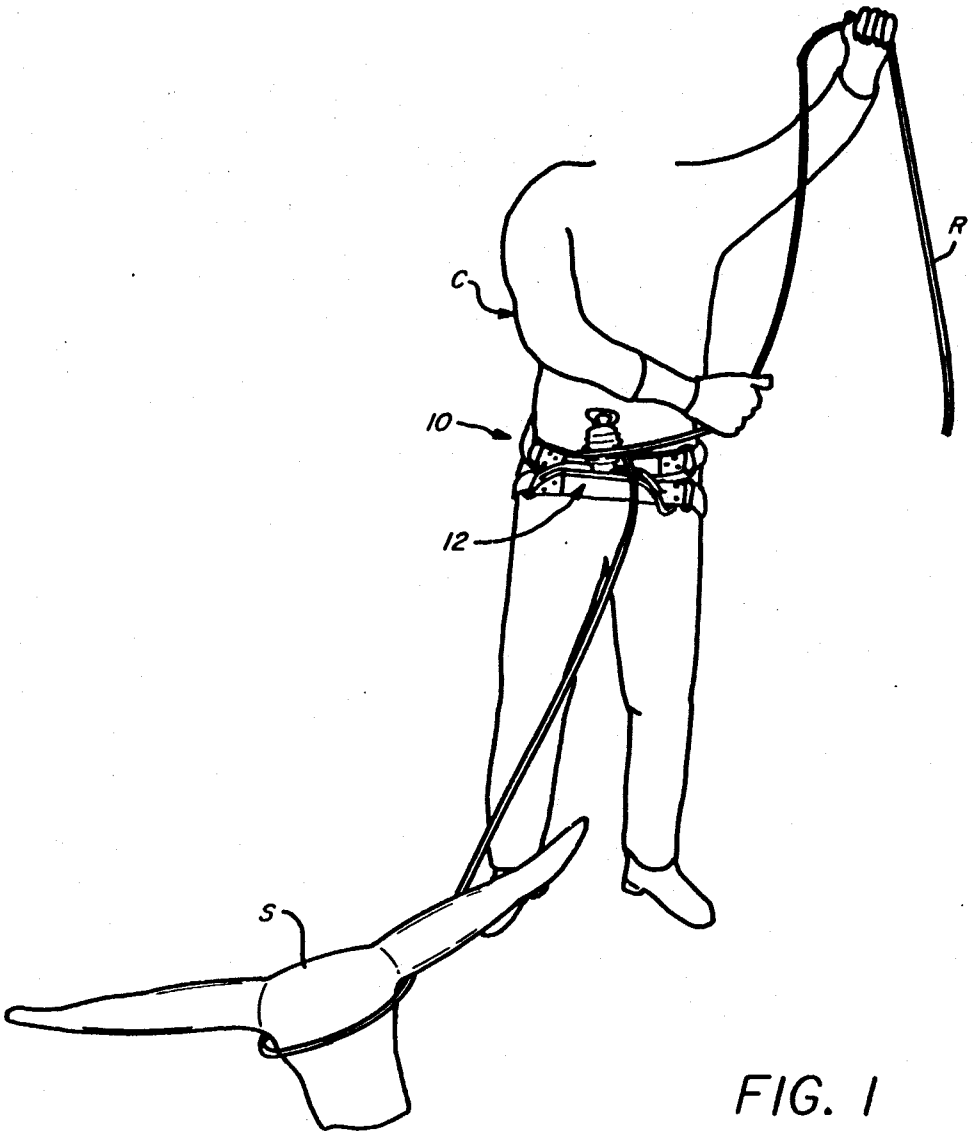
FIG. 1 is a front elevation view of the training apparatus according to the present invention showing the training apparatus attached to a roper, a roped dummy steer, and the dally.

In FIG. 1, a training apparatus according to the present invention is shown, designated generally by numerical reference 10, attached to the body of a roper C at a location about the roper's hips slightly below the waist. The training apparatus 10 is shown being used by the roper C with a rope R and a dummy steer S.

Figure 3:
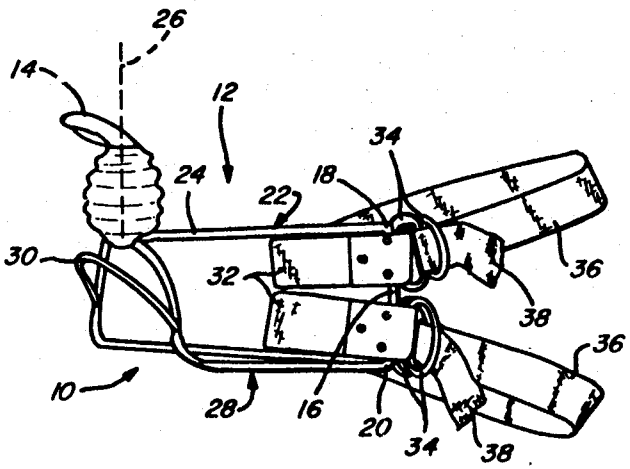
FIG. 3 is a side view of the training apparatus according to the present invention.
Figure 2:
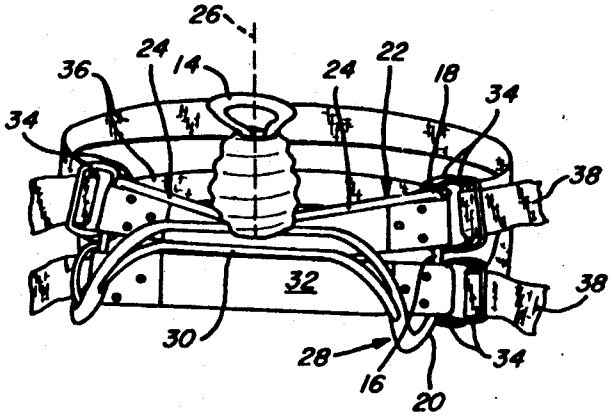
FIG. 2 is a front elevation view of the training apparatus according to the present invention.

In the preferred embodiment as shown in FIGS. 1, 2, and 3, the training apparatus 10 includes a box-like frame assembly 12 to which a saddle horn 14 is attached. The frame assembly 12 is made of sturdy, lightweight materials which can be bent or otherwise shaped to form the frame assembly 12 between the saddle horn 14 and the roper's body. The frame assembly 12 includes a pair of substantially vertical side portions 16, one on each side located near the roper's hips when attached, having an upper end 18 and a lower end 20. The upper ends 18 of the vertical side portions 16 are connected by an upper substantially horizontal member 22 having a pair of outwardly extending substantially straight portions 24 which join together at a spaced position from the roper at a midpoint 26. The saddle horn 14 is attached to extend upwardly from the upper horizontal member 22 at the midpoint 26.

Each lower end 20 of the vertical side portions 16 is connected to a lower portion 28 extending substantially horizontally outwardly away from and in front of the roper's body when the frame assembly 12 is properly attached to the roper C as shown in FIG. 1. The front ends of the lower portions 28 continue by extending upwardly and curving towards the midpoint 26. The lower portions 28 meet and attach to the lower portion of the saddle horn 14 at the midpoint 26. The saddle horn 14 is thus also attached to the lower portion 28 at approximately the midpoint 26. It is desirable to attach the lower portion 28 in addition to upper member 22 to the saddle horn 14. This structure is provided to stabilize the frame assembly 12 on the roper's pelvis and to prevent the saddle horn 14 from pivoting during the formation of the dally.

Referring to FIGS. 2 and 3, the box-like frame assembly 12 further includes a pommel-like member 30 which attaches at each end to the front of the lower portion 28.

The pommel member 30 is bent similar to the curved lower portion 28 and extends slightly in front of and below the saddle horn 14. The pommel member 30 simulates the pommel of the saddle, i.e. the protuberance at the front and top of the saddle.

It should be understood that the box-like frame assembly 12 according to the present invention may take other suitable forms. For example, the frame assembly 12 shown in the drawings may be enclosed within a cover or shell of plastic or other synthetic resin which has the appearance and shape of an actual saddle. As another alternative, the frame assembly 12 may be molded or otherwise formed as a unitary body (shown in phantom lines in the drawings) of plastic or other synthetic resin having the appearance and shape of an actual saddle. In this situation, the material from which the unitary body of the frame assembly is formed provides the requisite strength and structural integrity of the individual members of the frame assembly shown in the drawings.

Referring to FIGS. 2 and 3, a pair of front attaching straps 32 are attached to and extended between the vertical side portions 16 of the frame assembly 12, of whatever form is chosen. Additionally, both ends of each of the front straps 32 have attached to them a pair of connector rings 34, preferably D-rings, as shown in the general shape of the letter "D." A pair of securing belt straps 36 are used to secure the frame assembly 12 to the roper's body as shown in FIG. 1. The attaching straps 32 and securing straps 36 are preferably formed of a webbed belt-type of material for purposes of strength. The securing straps 36 are fixed about the roper's hips so that opposite end portions 38 of the securing straps 36 may be inserted through each pair of the D-rings 34. The ends 38 are then wrapped around the outer or front D-ring 34 before being passed back through the inner D-ring 34. The securing straps 36 can be drawn snug against the roper's hips by pulling on the ends 38 of the securing straps 36.

In use, the training apparatus 10 is positioned so that the frame assembly 12 is in front of the roper C at hip level with the pair of front straps 32 in contact with the front of the roper's body and the pair of securing straps 36 wrapped around the hips as shown in FIG. 1. The ends 38 of the pair of securing straps 36 are inserted through the D-rings 34 and pulled until the securing straps 36 are snugly against the roper's hips and then the ends 38 are looped back and tightened as described above. With the training apparatus 10 firmly in place, the location of the saddle horn 14 on the frame assembly 12 is in the same approximate location with respect to the roper's head and arms. Conditions are thus simulated as if the roper were sitting on an actual saddle on horseback, thus approximating the spatial relationship between the saddle horn 14 and the actual rider on horseback.

To illustrate how the training apparatus of the present invention is used and to more fully appreciate the advantages it offers it is necessary to consider the steps involved in a steer roping competition. "Rate off" is a term used in connection with this competition for the horse slowing down to the same speed as the stock it is pursuing. Additionally, the position of the horse with respect to the stock is different every time, thus it is very important to practice the correct form from roping the stock at every position and while moving. After roping the stock, the slack in the rope is pulled in by hand and the dally is performed by wrapping the rope around the saddle horn.

The training apparatus 10 can be used while standing in a stationary position or while walking or moving towards the dummy steer S at various speeds and at various angles. The roper can in fact simulate a roping run from a starting box during an actual roping run where one hand is on the saddle horn 14 before the animal is released. For actual roping practice, the roper C, having the rope R in hand, ropes the dummy steer S when at an ideal roping position, pulls in the slack in the rope R and performs the dally. The training apparatus 10 allows the roper C to perform and simulate any number of positions and techniques while roping the dummy steer S and forming the dally. Such practice thus makes it a natural reflex to act accordingly when roping and forming a dally from horseback. Furthermore, due to the space saving size and light-weight construction of the training apparatus 10, it can be taken anywhere easily.

The foregoing disclosure and description of the invention is illustrative and explanatory thereof, and various changes in the size, shape, and materials, as well as in the details of illustrative construction and assembly, may be made without departing from the spirit of the invention.

We claim:

1. A training apparatus for cattle roping to be used by a roper, comprising:

a frame assembly having a front portion and a rear portion, the front portion spaced from said rear portion a fixed distance adequate for clearance of the hand of the roper when forming a dally during cattle roping operations;

means for securing said rear portion of said frame assembly to the body of the roper; and a saddle horn attached to said front portion of said frame assembly, said saddle horn being spaced from the body of the roper by said frame assembly a distance allowing clearance of the hand of the roper when forming a dally during cattle roping operations.

2. The training apparatus according to claim 1, further comprising a pommel member connected to said frame assembly and extending in front of said saddle horn.

3. The training apparatus according to claim 1, wherein said securing means comprises a pair of securing straps adapted to releasably attach to said frame assembly and to pass around the body of the roper.

4. The training apparatus according to claim 1, wherein said frame assembly comprises a lightweight box-like framework and said front portion of said frame assembly includes a first rod segment and a second rod segment which are attached to said saddle horn to secure said saddle horn and prevent rotational movement of said saddle horn relative to said frame assembly.

5. The training apparatus according to claim 4, wherein said first and second rod segments extend through said saddle horn.

6. A training apparatus for cattle roping to be used by a roper, comprising:

a box-like frame assembly having a front, rear and two side portions, the front portion spaced from said rear portion a fixed distance adequate for clearance of the hand of the roper when forming a dally during cattle roping operations;

means for securing said frame assembly to the body of the roper; and a saddle horn attached to said front portion of said frame assembly, said saddle horn being spaced from the body of the roper by said frame assembly a distance allowing clearance of the hand of the roper when forming a dally during cattle roping operations.

7. The training apparatus according to claim 6, further comprising a pommel member connected to said frame assembly and extending in front of said saddle horn.

8. The training apparatus according to claim 6, wherein said securing means comprises a pair of securing straps adapted to releasably attach to said frame assembly and to pass around the body of the roper.

9. The training apparatus according to claim 6, wherein said front portion of said box-like frame assembly includes a first rod segment and a second rod segment which are attached to said saddle horn to secure said saddle horn and prevent rotational movement of said saddle horn relative to said box-like frame assembly.

10. The training apparatus according to claim 9, wherein said first and second rod segments extend through said saddle horn.

11. A method for practicing cattle roping utilizing a rope, a training apparatus having a saddle horn, and a dummy steer, comprising the steps of:

attaching the training apparatus to the hips of the roper;

maintaining the saddle horn a fixed distance from the body of the roper, the fixed distance simulating the distance experienced in forming a dally when riding in a saddle on a horse;

throwing a looped-end of the rope around the dummy steer;

pulling in the slack in the rope; and forming a dally on the saddle horn with the rope.

12. The method according to claim 11, further comprising the step of walking towards the dummy steer prior to and while throwing the looped-end of the rope.

13. The method according to claim 11, further comprising the step of moving relative to the dummy steer prior to and while throwing the looped-end of the rope.

14. The method according to claim 11, further comprising the step of moving relative to the dummy steer while forming the dally.

* * * * *